US009784466B2

(12) United States Patent
Kim et al.

(10) Patent No.: US 9,784,466 B2
(45) Date of Patent: Oct. 10, 2017

(54) AIR SUPPLY DAMPER FOR SEPARATELY SUPPLYING LEAKAGE AIR FLOW AND SUPPLEMENTARY AIR FLOW, METHOD FOR CONTROLLING THE SAME, AND SMOKE CONTROL SYSTEM UTILIZING THE SAME

(75) Inventors: Jung-Yup Kim, Seoul (KR); Hyun-Joon Shin, Seoul (KR)

(73) Assignee: KOREA INSTITUTE OF CONSTRUCTION TECHNOLOGY, Gyeonggi-do (KR)

( * ) Notice: Subject to any disclaimer, the term of this patent is extended or adjusted under 35 U.S.C. 154(b) by 1091 days.

(21) Appl. No.: 13/634,882

(22) PCT Filed: Oct. 21, 2011

(86) PCT No.: PCT/KR2011/007889
§ 371 (c)(1),
(2), (4) Date: Sep. 14, 2012

(87) PCT Pub. No.: WO2012/057474
PCT Pub. Date: May 3, 2012

(65) Prior Publication Data

US 2013/0005236 A1 Jan. 3, 2013

(30) Foreign Application Priority Data

Oct. 28, 2010 (KR) ..... 10-2010-0106294

(51) Int. Cl.
*F24F 13/14* (2006.01)
*F24F 11/00* (2006.01)
*F24F 11/04* (2006.01)

(52) U.S. Cl.
CPC ..... *F24F 11/0086* (2013.01); *F24F 11/04* (2013.01); *F24F 2011/0042* (2013.01); *F24F 2011/0095* (2013.01)

(58) Field of Classification Search
CPC ..... F24F 11/0086; F24F 11/04; F24F 2011/0042; F24F 2011/0095;
(Continued)

(56) References Cited

U.S. PATENT DOCUMENTS 3,354,946 A * 11/1967 Dean, Jr. ..... F24F 3/056 165/48.1
3,884,133 A * 5/1975 Miller ..... 454/229
(Continued)

OTHER PUBLICATIONS

British Standards Institution, "Smoke and heat control systems", British Standard, Mar. 15, 2006, pp. 1-54.

*Primary Examiner* — Gregory Huson
*Assistant Examiner* — Dana Tighe
(74) *Attorney, Agent, or Firm* — Jianq Chyun IP Office

(57) ABSTRACT

Disclosed is a smoke control system provided in a high-rise building for separately supplying leakage air flow and supplementary air flow, including: a blowing means for supplying air into a building; a ventilating means having a leakage air flow supplying passage and a supplementary air flow supplying passage connected to the blowing means for introducing air; and an air supply damper connected to the leakage air flow supplying passage and the supplementary air flow supplying passage to supply air into each lobby of a building according to the leakage air flow and supplementary air flow.

9 Claims, 7 Drawing Sheets

(58) Field of Classification Search
CPC ..... F24F 2011/0004; F24F 2011/0005; F24F 7/06; F24F 2221/50; E04F 11/02
USPC ..... 454/49, 188, 189, 195, 238, 239, 249, 454/254, 257, 322, 333, 340, 342, 369, 454/370; 169/48; 236/49.2
See application file for complete search history.

(56) References Cited

U.S. PATENT DOCUMENTS

| | | | | | |
|---|---|---|---|---|---|
| 3,926,101 | A | * | 12/1975 | Moss | 454/229 |
| 4,054,084 | A | * | 10/1977 | Palmer | 454/342 |
| 4,068,568 | A | * | 1/1978 | Moss | 454/238 |
| 5,718,627 | A | * | 2/1998 | Wicks | 454/68 |
| 5,788,571 | A | * | 8/1998 | Ivison et al. | 454/252 |
| 7,798,418 | B1 | | 9/2010 | Rudd | |
| 2009/0047894 | A1 | * | 2/2009 | Coogan | 454/238 |

* cited by examiner

[FIG.4]
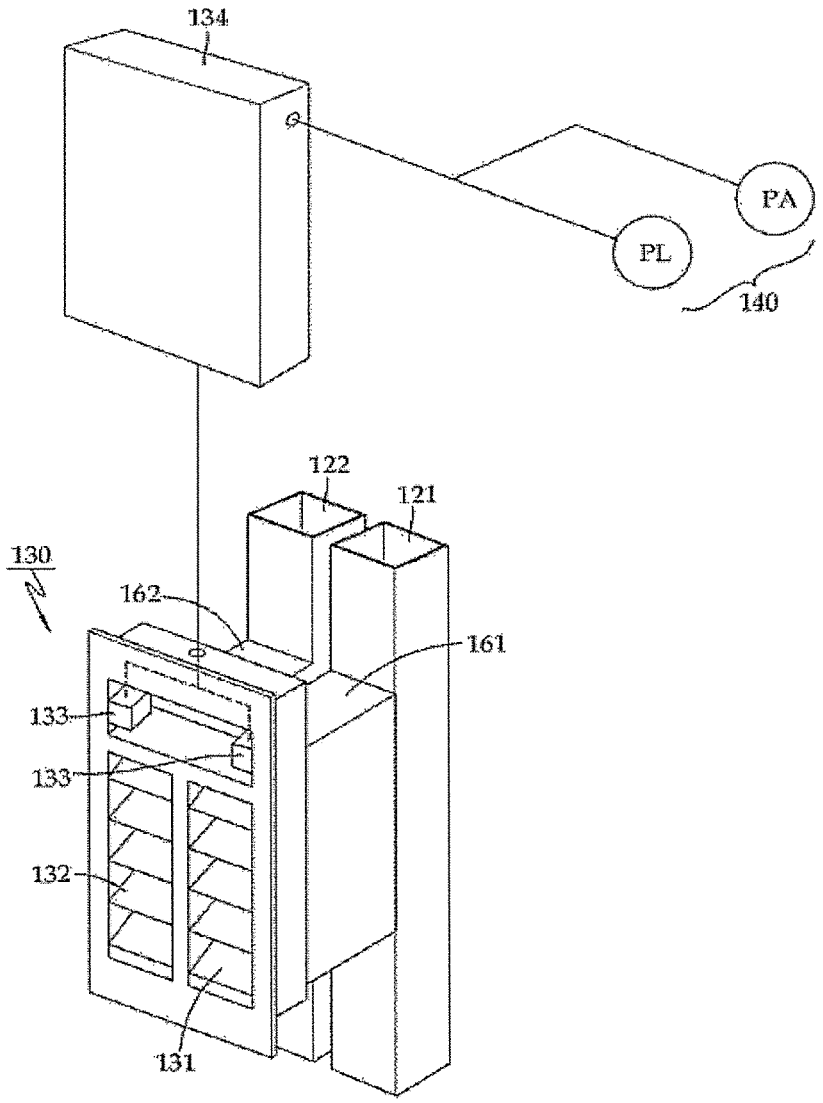

[FIG.6]
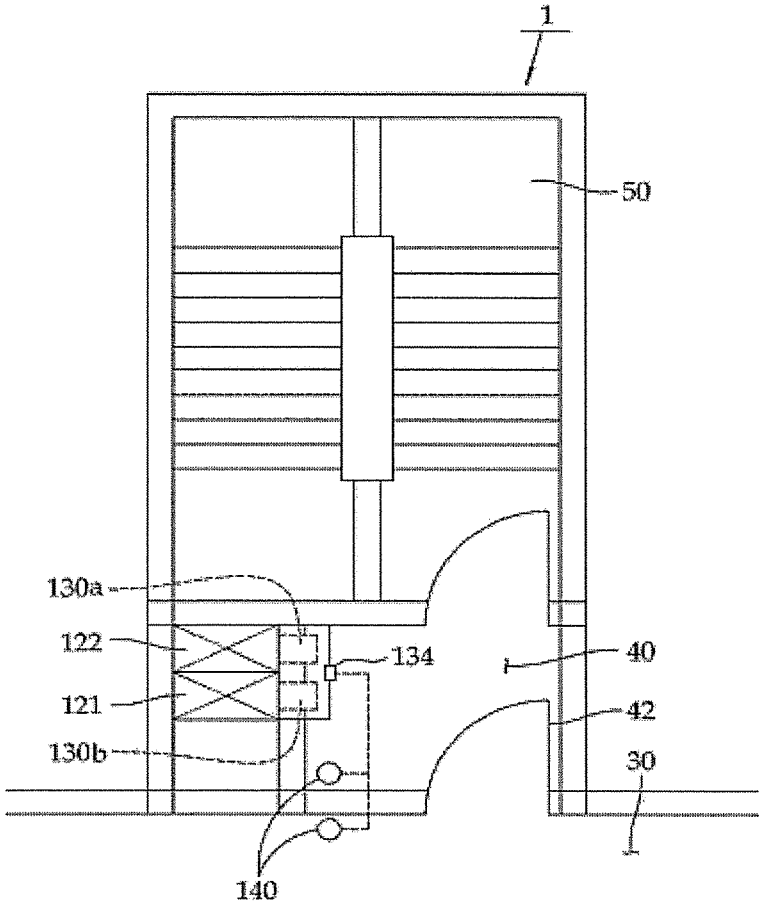

[FIG.7]
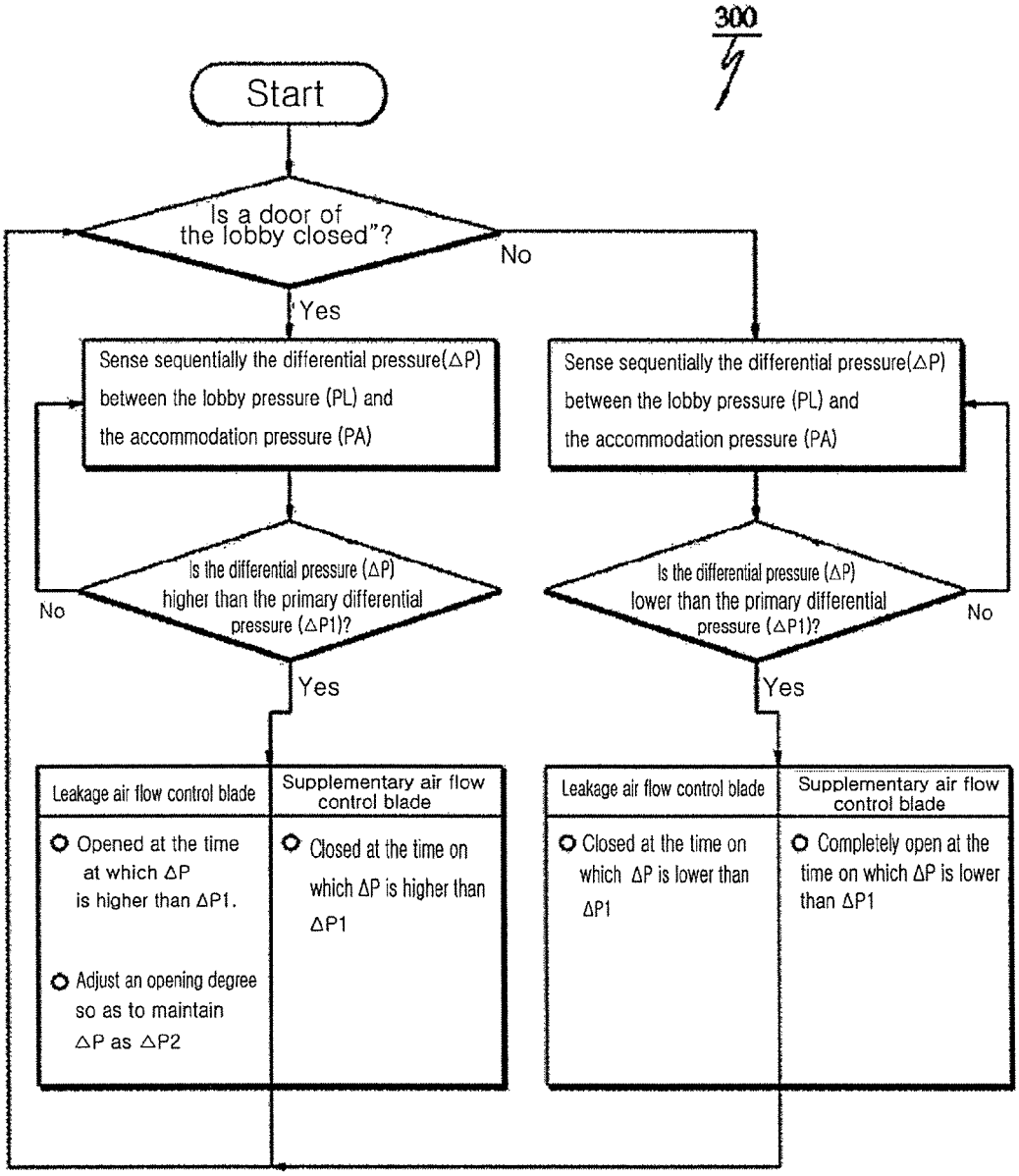

AIR SUPPLY DAMPER FOR SEPARATELY SUPPLYING LEAKAGE AIR FLOW AND SUPPLEMENTARY AIR FLOW, METHOD FOR CONTROLLING THE SAME, AND SMOKE CONTROL SYSTEM UTILIZING THE SAME

CROSS-REFERENCE TO RELATED APPLICATION

This application is a 371 of international application of PCT application serial no. PCT/KR2011/007889, filed on Oct. 21, 2011, which claims the priority benefit of Korean application no. 10-2010-0106294, filed on Oct. 28, 2010. The entirety of each of the above-mentioned patent applications is hereby incorporated by reference herein and made a part of this specification.

BACKGROUND OF THE DISCLOSURE

Technical Field

The present invention relates to an air supply damper employed in a smoke control system provided in a high-rise building, and more particular, to an air supply damper having a function for separately supplying leakage air flow and supplementary air flow, which is connected to a utility-pipe conduit which separately supplies leakage air flow and supplementary air flow, to separately adjust the supply of leakage air flow and supplementary air flow for preventing in advance, differential pressure between an accommodation and a lobby (smoke control zone) from becoming lower or higher than a standard value, and to provide occupants with safety evacuation conditions in case of a fire in the building, a method for controlling the same and a smoke control system utilizing the same.

Background Art

In general, as buildings become larger, higher and more complex due to integration and sophistication of the metropolis, buildings which are vulnerable to fire have increased, thus an effective fire prevention measure ensuring safety of life is urgently required.

In particular, the importance of a smoke control system for controlling smoke, which causes inconvenience during evacuation and fire extinguishing activities and poses a significant threat to the safety of life when a fire occurs in a building, has been emphasized.

In Korea, in order to prevent smoke from penetrating into an evacuation stairwell and to secure safety evacuation routes, a design guide for a smoke control system of a special evacuation stairwell and lobby according to NFSC (National Fire Safety Codes 501A) has been proposed.

The above design guide requires that a differential pressure of 40 Pa (in the case where a sprinkler is provided, 12.5 Pa) should be maintained between smoke control zones to prevent smoke from penetrating into a smoke control zone and an accommodation, a force required for opening a door of the smoke control zone should be 110 N or less, and air egress velocity of 0.5 m/s to 0.7 m/s or more should be obtained in a case where the door of the smoke control zone is temporarily opened for evacuation.

A method which has been widely utilized for achieving the above purpose is a pressurized smoke control system which employs a smoke control blower and a vertical flow passage to supply external air into a lobby located between an accommodation and a staircase, thereby controlling smoke in the lobby.

The above conventional pressurized smoke control system 1 is illustrated in FIGS. 1A and 1B.

As shown in FIGS. 1A and 1B, that is, the above conventional pressurized smoke control system adopts the manner in which external air is supplied through an air supply damper 32 provided in a lobby 40 among an accommodation 30, a corridor of the building, and a staircase 50 by means of an air supply blower 10 for controlling smoke and one air supplying passage 20 passing a utility-pipe conduit 22 to increase pressure in the lobby 40.

The lobby 40 is set as a smoke control zone, and in order to prevent smoke from being penetrated from the accommodation 30 in which a fire occurs to the lobby 40, the above conventional pressurized smoke control system 1 maintains a differential pressure, which is a larger than a standard value, between the lobby 40 and the accommodation 30. And, in order to keep a force required for opening a door 42 below a certain standard to make it easier for occupants to open the door 42, that is, in order to prevent an overpressure from being formed in the lobby 40, the conventional pressurized smoke control system adjusts the differential pressure between the lobby 40 and the accommodation 30 to a range (standard value) between an upper limit and a lower limit.

At this time, in order to maintain the differential pressure according to a standard value, when the differential pressure is formed between the lobby 40 and the accommodation 30, the amount of air supplied into the lobby should be as much as the amount of air leaked from the lobby 40 through a gap between a wall and the door 42 of the lobby 40. The amount of air to be supplied into the lobby for this condition is referred to as "leakage air flow".

In the meantime, in the case where the door 42 of the lobby 40 is temporarily opened, in order to maintain the air egress velocity required for preventing smoke from being introduced from the accommodation 30 to the lobby 40, external air should be supplied to the lobby. The amount of air supplied into the lobby for this condition is referred to as "supplementary air flow".

In the design of the conventional pressurized smoke control system 1, in view of the above, leakage air flow and supplementary air flow are calculated, and the amount of air supply of the blower for controlling smoke is then calculated as the sum of the supplementary air flow and the leakage air flow, and is supplied into the lobby.

In the conventional pressurized smoke control system 1, in addition, in the case where the amount of air supply calculated by adding the supplementary air flow and the leakage air flow is supplied to the lobby 40 of each floor from the smoke control blower 10 through a vertical air flow passage 22, it is necessary to adjust the amount of air supplied into the lobby 40 of each floor.

In other words, as illustrated, if the door 42 of the lobby 40 is closed, a differential pressure which is larger than a certain standard should be maintained to prevent smoke from penetrating through a gap between a wall and the door. In order to allow an occupant to open the door without any difficulty during evacuation, overpressure should be simultaneously prevented in order to lower an opening force required for opening the door to less than a certain standard, that is, for preventing overpressure from being generated in the lobby 40.

For the above purpose, the amount of air (air volume) supplied into the lobby of each floor should be adjusted so as to adjust the differential pressure between the lobby and the accommodation within a range between the upper limit and the lower limit.

In addition, when the door of the lobby is opened, the amount of the air supplied into the lobby to generate air egress velocity should be more than a standard value.

In order to satisfy design conditions of the pressure the air egress velocity in the lobby, the automatic differential pressure and overpressure control-type air supply damper 32 has been employed in a majority of buildings.

As shown in FIG. 2A, the automatic differential pressure and overpressure control-type air supply damper 32 is provided between a wall of the lobby 40 and the air supplying passage 20. A damper blade 32*a*is normally shut to not allow air current to be flowed between the lobby 40 and the air supplying passage 20, and if a fire occurs, as shown in FIG. 2B, the damper blade 32*a*is rotated by a driving motor 32*b* to supply air to the air supplying passage 20 in the lobby 10.

At this time, a pressure sensor and the like senses a differential pressure between the lobby 40 and the accommodation 30 to adjust an opening degree of the damper blade 32 for adjusting amount of air supplied to the lobby, consequently, a maintenance of the differential pressure between lobby 40 and the accommodation 30, a prevention of overpressure and a formation of the air egress velocity are automatically performed.

Accordingly, once the fire occurs, the conventional automatic differential pressure and overpressure control-type air supply damper 32 is operated and the damper blade 32*a* is opened to supply the air required for controlling the smoke into the lobby.

And, the opening degree of the damper blade 32*a* is increased until the differential pressure between the lobby 40 and the accommodation 30 is reached to the designed differential pressure to increase the amount of air supplied into the lobby.

While the differential pressure is increased according to the amount of air supplied into the lobby, once the differential pressure becomes larger than the designed the differential pressure, the opening degree of the damper blade 32*a* is decreased in the reverse direction to reduce the supplied amount of air and reduce the differential pressure between the lobby 40 and the accommodation 30.

However, if the differential pressure is smaller than the designed differential pressure, the opening degree of the damper blade 32*a* is again increased to increase amount of air. In other words, the differential pressure formed between the lobby 40 and the accommodation 30 is compared with the designed differential pressure and amount of supplied air is adjusted according to the result of comparison.

Meanwhile, once the door 42*a* of the lobby 40 is opened and the differential pressure becomes nearly 0 (zero), the damper is completely opened to 100% and amount of supplied air is maximized to form the air egress velocity toward the door is formed.

As illustrated above, the conventional automatic differential pressure and overpressure control-type air supply damper 32 senses the differential pressure formed between the lobby 40 and the accommodation 30 through the pressure sensor, adjusts the opening degree of the damper blade to maintain the differential pressure formed between the lobby 40 and the accommodation 30 to the designed differential pressure and forms simultaneously the air egress velocity at the time of opening the door.

However, after reviewing a result of the in-site performance evaluation of the pressurized smoke control system 1 installed and operated in the real building, it is found that the pressurized smoke control systems 1 in the considerable number of buildings do not show the designed performances. In other words, there are frequent occasions when the differential pressure formed between the accommodation 30 and the lobby 40 which is a smoke control zone is formed as an overpressure exceeding the standard value or as a low pressure smaller than the standard value.

In particular, it can be seen that when the door 42 of the lobby 40 is opened according to an evacuation of occupants, the differential pressure in a floor besides the floor in which the opened door, which is maintained as the proper value prior to opening the door is significantly lowered.

The fundamental factors causing above conditions can be found from the design concept in which amount of air to be supplied is calculated as the sum of leakage air flow and supplementary air flow and this amount of air to be supplied is supplied to one vertical air supply passage 20 and an operation of the conventional automatic differential pressure and overpressure control-type air supply damper 32 which controls simultaneously amount of the leakage air flow and amount the supplementary air flow to be supplied.

In addition to the normal leakage air flow for forming the proper differential pressure for controlling smoke, the supplemental air flow for satisfying the air egress velocity is additionally supplied so that in the case where the doors of all the floors are closed, the excessive amount of air is supplied.

In addition, once the door 42 of the lobby 40 is opened, since some of the leakage air flow together with the supplementary air flow are exhausted from the floor in which the door is opened, amount of air which is smaller than the normal leakage air flow is supplied to another floor so that the differential pressure which is smaller than the standard value is formed between the accommodation 30 and the lobby 40.

In view of the above, like the design concept of the pressurized smoke control system 1, if the smoke control system 1 designed on the basis of the conventional automatic differential pressure and overpressure control-type air supply damper 32 in which leakage air flow and supplementary air flow are simultaneously supplied through one air supply passage 20 and leakage air flow and supplementary air flow are supplied to the same flow passage and controlled is installed and operated in the high-rise building, since there is high probability that the differential pressure formed between the accommodation and the lobby is smaller or larger than the design standard, the installation purpose of the pressurized smoke control system 1 cannot be achieved, and so the improvement for the above has been required.

SUMMARY OF THE DISCLOSURE

DISCLOSURE

Technical Problem

An object of the present invention is to solve the problems of the conventional air supply damper and to provide an air supply damper having a function for separately supplying leakage air flow and supplementary air flow, which is connected to a utility-pipe conduit which separately supplies a leakage air flow and a supplementary air flow, to separately adjust a supply of leakage air flow and supplementary air flow for preventing in advance a differential pressure between an accommodation and a lobby (smoke control zone) becoming lower or higher than a standard value and to provide occupants with a safety evacuation condition in case of a fire in a high-rise building, a method for controlling the same and a smoke control system utilizing the same.

Technical Solution

In the present invention for achieving the above object, an air damper (leakage air flow supplying damper and supplementary air flow supplying damper) for communicating a leakage air flow control blade and a supplementary air flow control blade with a leakage air flow supplying passage and a supplementary air flow supplying passage of a vertical flow passage side by side through a leakage air flow connecting duct and a supplementary air flow connecting duct, is provided to enable supply of leakage air flow and supply of supplementary air flow to be separately adjusted, a differential pressure between a lobby pressure and an accommodation pressure is measured by a pressure sensing sensor, and an opening rate of the leakage air flow control blade or the supplementary air flow control blade is separately adjusted by utilizing the measured differential pressure.

In the above condition, in a state where the door of a lobby is closed, the pressure-sensing sensor senses successively a differential pressure between the lobby pressure and the accommodation pressure, if the current sensed differential pressure is larger than a primary differential pressure set in a control logic, the leakage air flow control blade is opened and the supplementary air flow control blade is shut to supply only leakage air flow into the lobby, and the opening rate of the leakage air flow control blade is adjusted to maintain the differential pressure between the lobby pressure and the accommodation at a design standard differential pressure.

In a state where the door of a lobby is closed, in addition, the pressure-sensing sensor senses successively a differential pressure between the lobby pressure and the accommodation pressure, if the current sensed differential pressure is smaller than a primary differential pressure set in a control logic, the supplementary air flow control blade is opened and the leakage air flow control blade is shut to supply only supplementary air flow into the lobby.

Thus, according to the present invention, it is possible to prevent in advance, differential pressure between the lobby, which is a smoke control zone, and the accommodation from becoming lower or higher than the design standard, and to provide safety evacuation conditions when a fire occurs in the high-rise building.

In order to achieve the above objects, the present invention provides an air supply damper of a smoke control system provided in a high-rise building for separately supplying leakage air flow and supplementary air flow, including a leakage air flow control blade and a supplemental air flow control blade provided in a leakage air flow supplying passage and a supplementary air flow supplying passage of a utility-pipe conduit for separately supplying leakage air flow and supplementary air flow, respectively, through a leakage air flow connecting duct and a supplementary air flow connecting duct, the leakage air flow control blade and the supplemental air flow control blade being arranged in parallel with each other and capable of adjusting the supply of leakage air flow and supplementary air flow; a pressure-sensing sensor measuring differential pressure between a lobby pressure and an accommodation pressure; and a controller receiving the measured pressure value from the pressure-sensing sensor, and separately driving driving motors which open/shut the leakage air flow control blade and the supplemental air flow control blade, respectively, wherein, an opening rate of the leakage air flow control blade or the supplementary air flow control blade is separately adjusted through the driving motors by means of the differential pressure between the lobby pressure and the accommodation pressure obtained by the pressure-sensing sensor to adjust the supplying amount of leakage air flow or supplementary air flow.

In addition, the present invention provides the air supply damper having the function for separately supplying leakage air flow and supplementary air flow, wherein the pressure-sensing sensor senses successively the differential pressure between the lobby pressure and the accommodation pressure, judges that a door of a lobby is closed if the current sensed differential pressure is larger than a primary differential pressure set in a control logic, opens the leakage air flow control blade and shuts the supplementary air flow control blade to supply only leakage air flow into the lobby, and adjusts the opening rate of the leakage air flow control blade to maintain the differential pressure between the lobby pressure and the accommodation at a design standard differential pressure.

Further, the present invention provides the air supply damper having the function for separately supplying leakage air flow and supplementary air flow, wherein the pressure-sensing sensor senses successively the differential pressure between the lobby pressure and the accommodation pressure, judges that a door of the lobby is opened if the current sensed differential pressure is smaller than a primary differential pressure set in a control logic, opens the supplementary air flow control blade and shuts the leakage air flow control blade to supply only the supplementary air flow into the lobby.

In order to achieve the above objects, the present invention provides a method of an air supply damper of a smoke control system provided in a high-rise building, the air supply damper having the function for separately supplying leakage air flow and supplementary air flow, including the steps of judging whether a door of a lobby is closed; sensing successively a differential pressure between a lobby pressure and an accommodation pressure; determining whether the sensed differential pressure is larger than a primary differential pressure set in a control logic; and separately adjusting an opening rate of the leakage air flow control blade or the supplementary air flow control blade on the basis of the sensed differential pressure to separately adjust the supplying amount of leakage air flow or supplementary air flow.

And, the present invention preferably provides the method for controlling the air supply damper having the function for separately supplying leakage air flow and supplementary air flow, in which if the sensed differential pressure is larger than the primary differential pressure set in the control logic in the case where the door of the lobby is closed, the leakage air flow control blade is opened at the time at which the sensed differential pressure becomes larger than the primary differential pressure, to adjust an opening rate of the leakage air flow control blade for maintaining the sensed differential pressure at a design standard differential pressure, and the supplementary air flow control blade is shut at the time at which the sensed differential pressure becomes larger than the primary differential pressure, to supply only leakage air flow into the lobby.

Furthermore, the present invention preferably provides the method for controlling the air supply damper having the function for separately supplying leakage air flow and supplementary air flow, in which if the sensed differential pressure is smaller than the primary differential pressure set in the control logic in the case where the door of the lobby is opened, the leakage air flow control blade is shut at the time at which the sensed differential pressure becomes smaller than the primary differential pressure, the supplementary air flow control blade is completely opened at the time at which the sensed differential pressure becomes smaller than the primary differential pressure, to supply only supplementary air flow into the lobby.

In order to achieve the above objects, the present invention provides a smoke control system provided in a high-rise building for separately supplying leakage air flow and supplementary air flow, including a blowing means for supplying air into a building; a ventilating means having a leakage air flow supplying passage and a supplementary air flow supplying passage connected to the blowing means for introducing air; and an air supply damper connected to the leakage air flow supplying passage and the supplementary air flow supplying passage to supply air into each lobby of a building according to the leakage air flow and supplementary air flow, wherein the supply of leakage air flow and the supply of supplementary air flow are provided into the building through separate flow passages.

As illustrated, the present invention can separately supply leakage air flow and supplementary air flow into the lobby when a fire occurs in the high-rise building to prevent differential pressure generated between the lobby and the accommodation from becoming lower or higher than the design standard, and to provide safety evacuation conditions.

Furthermore, the present invention preferably provides the smoke control system in a high-rise building for separately supplying leakage air flow and supplementary air flow, in which the blowing means is provided with a leakage air flow supplying blower and a supplementary air flow supplying blower for supplying air into the building, the ventilating means includes a leakage air flow supplying passage and a supplementary air flow supplying passage connected to the leakage air flow supplying blower and the supplementary air flow supplying blower to allow the air to be introduced, and the air supply damper is provided with a leakage air flow supplying damper and a supplementary air flow supplying damper connected to the leakage the air flow supplying passage and the supplementary air flow supplying passage, respectively, to supply air into each lobby of the building, for allowing leakage air flow and supplementary air flow to be separately supplied into the lobby of each floor of the building.

Furthermore, the present invention preferably provides the smoke control system in a high-rise building for separately supplying leakage air flow and supplementary air flow further including a pressure-sensing sensor for sensing pressure in the lobby and pressure in an accommodation of the building. Here, the leakage air flow supplying damper having an automatic opening/shutting device mounted therein for closing the leakage air flow supplying damper when the differential pressure between the pressures of the lobby and the accommodation sensed by the pressure-sensing sensor is smaller than a certain differential pressure, and opening the leakage air flow supplying damper when the differential pressure between the pressures of the lobby and the accommodation is larger than a certain differential pressure, and the supplementary air flow supplying damper having an automatic opening/shutting device mounted therein for closing the supplementary air flow supplying damper when the differential pressure between the pressures of the lobby and the accommodation sensed by the pressure-sensing sensor is larger than a certain differential pressure, and opening the supplementary air flow supplying damper when the differential pressure between the pressures of the lobby and the accommodation is smaller than a certain differential pressure.

Also, the present invention preferably provides the smoke control system in a high-rise building for separately supplying leakage air flow and supplementary air flow, in which in the case where the doors of the lobbies of all the floors of the building are closed so that a certain differential pressure is formed between the lobbies and the accommodations, the leakage air flow is supplied into the lobby of each floor through the leakage air flow supplying blower, the leakage air flow supplying passage and the leakage air flow dampers and the supplementary air flow supplying dampers in all the floors are shut so that the supply of supplementary air flow is blocked.

In addition, the present invention preferably provides the smoke control system in a high-rise building for separately supplying leakage air flow and supplementary air flow, in which in the case where the doors of the lobbies of all the floors of the building are opened so that a differential pressure is not formed between the lobbies and the accommodations, the supplementary air flow supplying dampers are opened to supply only supplementary air flow into the lobbies having the opened doors, and the leakage air flow supplying dampers are shut so that leakage air flow is not supplied.

Preferably, the present invention provides the smoke control system in a high-rise building for separately supplying leakage air flow and supplementary air flow, in which in the case where the doors of the lobbies of all the floors of the building are opened so that a differential pressure is not formed between the lobbies and the accommodations, the automatic opening/shutting devices of the supplementary air flow supplying dampers are opened to supply only supplementary air flow into the lobbies having the opened doors, and the automatic opening/shutting devices of the leakage air flow supplying dampers are shut so that leakage air flow is not supplied.

Advantageous Effects

According to the present invention, leakage air flow and supplementary air flow are supplied into a lobby provided on each floor of a high-rise building through separate flow passages, respectively, and so when a fire occurs in the building, it is possible to effectively prevent differential pressure generated between the lobby and the accommodation from becoming lower or higher than the design standard, and to provide safety evacuation conditions.

In addition, according to the present invention, since the pressure-sensing sensor is mounted in the lobby and the accommodation of the building for sensing pressure, and the automatic opening/shutting device is mounted in the air supply damper (the leakage air flow supplying damper and the supplementary air flow damper having the function of supplying separately leakage air flow and supplementary air flow), it is possible to more properly maintain the differential pressure formed between the lobby and the accommodation, and to provide safety evacuation conditions when a fire occurs.

BRIEF DESCRIPTION OF THE DRAWINGS

Description of Drawings

Figure 1A:
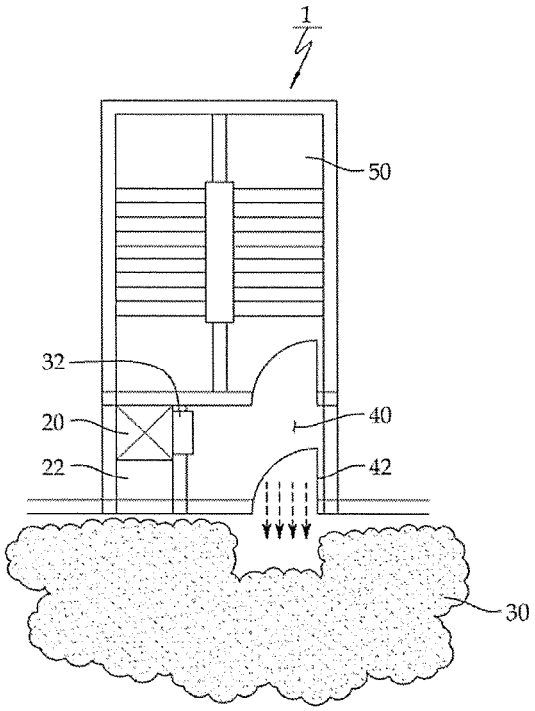
FIG. 1A(PRIOR ART)
Figure 1B:
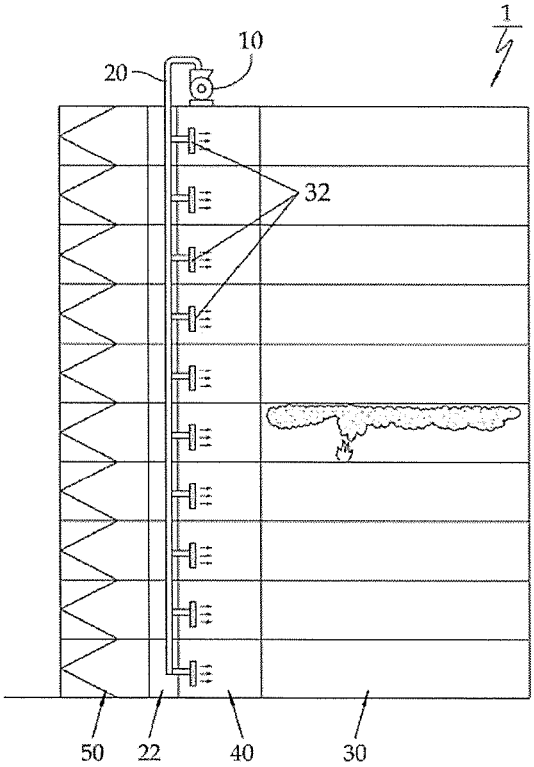
FIG. 1B(PRIOR ART)

FIGS. 1A and 1B are a plane view and a cross-sectional view of a building for illustrating a conventional pressurized smoke control system.

Figure 2A:
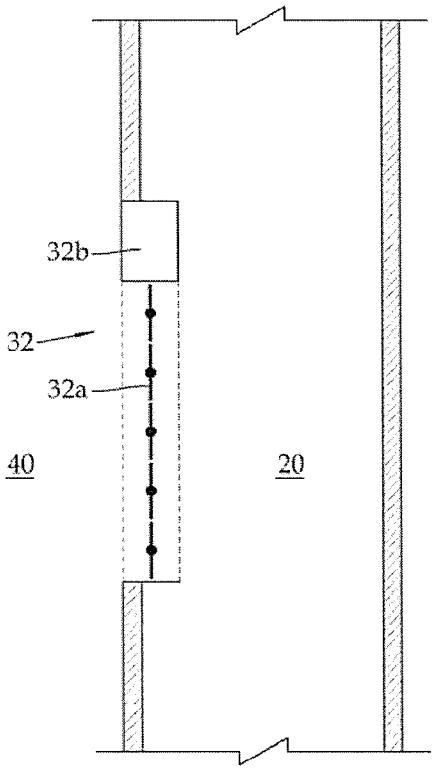
FIG. 2A(PRIOR ART)
Figure 2B:
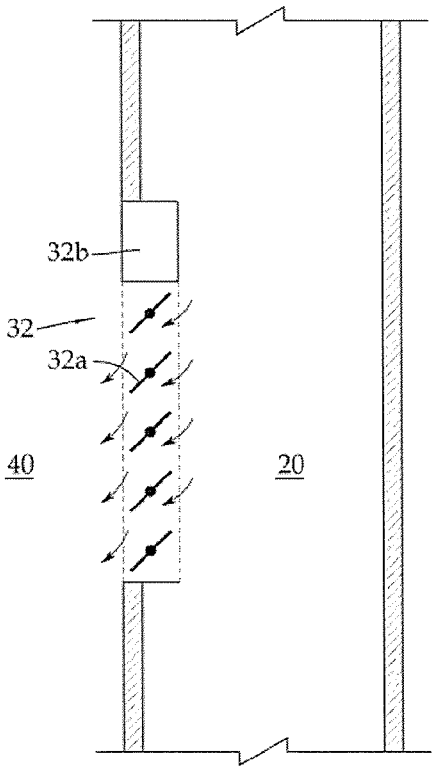
FIG. 2B(PRIOR ART)

FIGS. 2A and 2B are a cross-sectional view illustrating a state in which an air supply damper in a conventional pressure differential smoke control system is shut, and a cross-sectional view illustrating a state in which an air supply damper in a conventional pressurized smoke control system is open.

Figure 3:
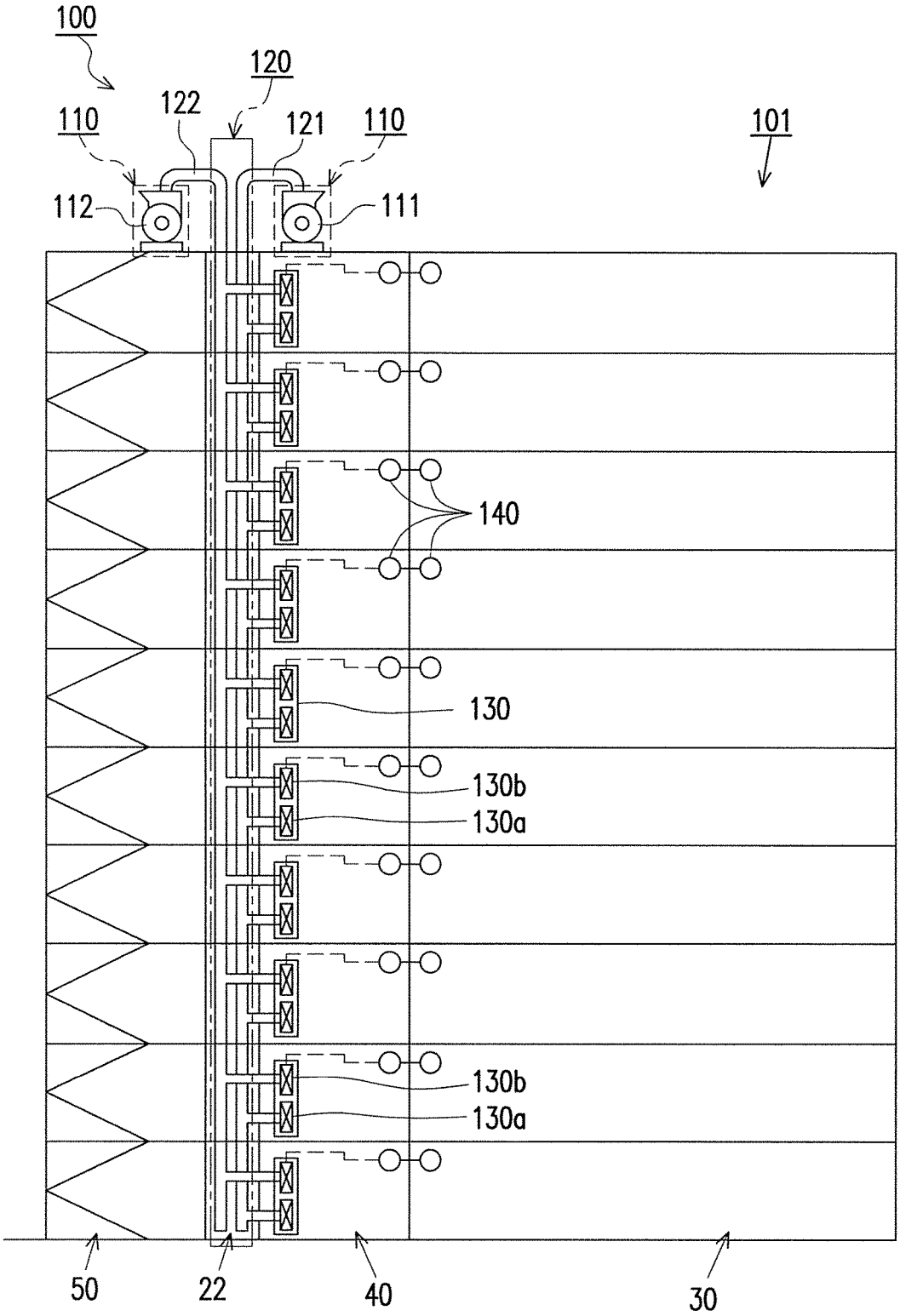

FIG. 3 is a cross-sectional view of a building provided with a smoke control system for a high-rise building which supplies separately a leakage air flow and a supplementary air flow.

FIG. 4 is a perspective view illustrating an air supply damper according to the present invention having a function for separately supplying leakage air flow and supplementary air flow.

Figure 5A:
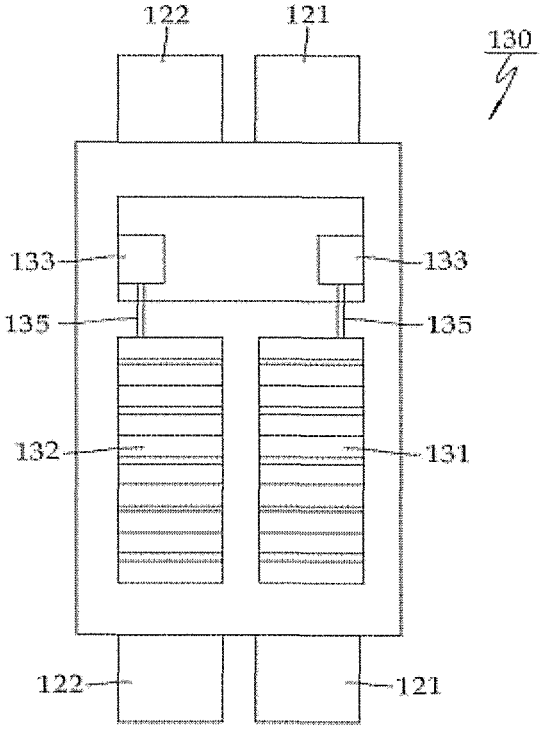
Figure 5B:
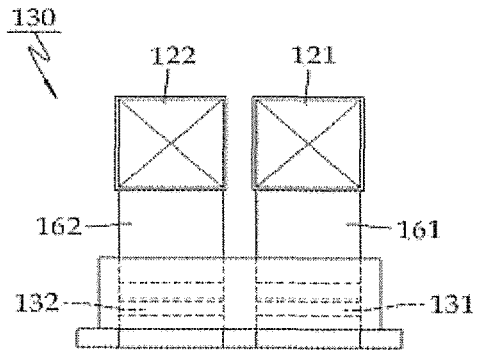
Figure 5C:
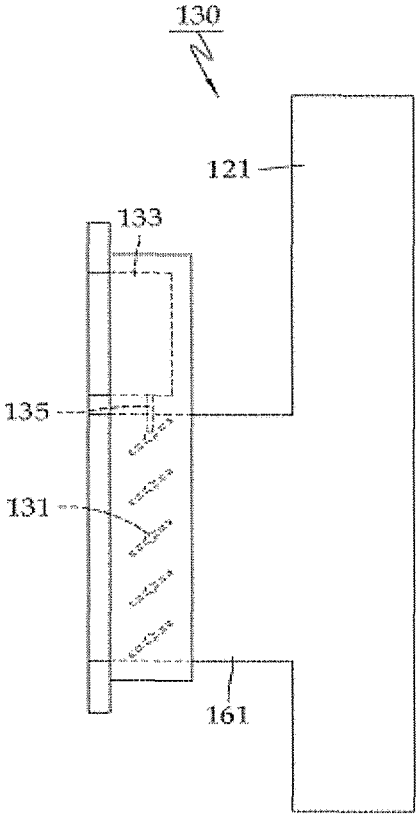

FIGS. 5A, 5B, and 5C are a front view, a plane view and a side view of an air supply damper according to the present invention having a function for separately supplying leakage air flow and supplementary air flow.

FIG. 6 is a plane view illustrating that an air supply damper according to the present invention having a function for separately supplying leakage air flow and supplementary air flow, is mounted in a lobby of a building and operated.

FIG. 7 is a flowchart illustrating sequentially the methods for controlling an air supply damper according to the present invention having a function for separately supplying leakage air flow and supplementary air flow.

DETAILED DESCRIPTION OF THE DISCLOSED EMBODIMENTS

[Mode for Invention]

Hereinafter, the preferred embodiment of the present invention will be described in more detail with reference to the accompanying drawings.

A smoke control system 100 for a high-rise building according to the present invention is the smoke control system 100 for separately supplying leakage air flow and supplementary air flow into a lobby 40 of a building 101.

As shown in FIG. 3, the smoke control system 100 for a high-rise building according to the present invention is provided with a blowing means 110 for supplying air into the building 101, and such blowing means 110 includes a leakage air flow supplying blower 111 and a supplementary air flow supplying blower 112.

The smoke control system is also provided with a ventilating means 120 having a leakage air flow supplying passage and a supplementary air flow supplying passage, each of which being connected to the blowing means 110 to allow air to be entered.

The above ventilating means 120 includes a leakage air flow supplying passage 121 and a supplementary air flow supplying passage 122 connected to the leakage air flow supplying blower 111 and the supplementary air flow supplying blower 112, respectively, and extended along a utility-pipe conduit 22 of the building 101. The leakage air flow supplying passage 121 and the supplementary air flow supplying passage 122 are disposed and extended in parallel with each other in the utility-pipe conduit 22, and form a leakage air flow supplying passage and a supplementary air flow supplying passage, respectively.

In addition, the smoke control system is provided with an air supply damper 130 connected to the leakage air flow supplying passage and the supplementary air flow supplying passage of the ventilating means 120 to separately supply air into each lobby 40 of the building 101 according to the leakage air flow and supplementary air flow. The above air supply damper 130 consists of a leakage air flow supplying damper 130*a* and a supplementary air flow supplying damper 130*b* connected to the leakage air flow supplying passage 121 and the supplementary air flow supplying passage 122, respectively, to supply air into each lobby 40 of the building 101.

In the smoke control system 100 according to the present invention for separately supplying leakage air flow and supplementary air flow, accordingly, the leakage air flow supplying passage 121 connected to the leakage air flow supplying blower 111 and the leakage air flow supplying damper 130*a* connected to the leakage air flow supplying passage 121 form the leakage air flow supplying passage, and the supplementary air flow supplying passage 122 connected to the supplementary air flow supplying blower 112 and the supplementary air flow supplying damper 130*b* connected to the supplementary air flow supplying passage 122 form the supplementary air flow supplying passage so that leakage air flow and supplementary air flow are supplied into the building 101 through respective flow passages.

In addition, the smoke control system according to the present invention includes a pressure-sensing sensor 140 for sensing pressure in the lobby 40 and pressure in an accommodation 30 of the building 101. Also, an automatic opening/shutting device described below is mounted in each of the leakage air flow supplying damper 130*a* and the supplementary air flow supplying damper 130*b*.

Furthermore, the pressure-sensing sensor 140 is electrically connected to a controller, and this controller is connected to the automatic opening/shutting devices of the leakage air flow supplying damper 130*a* and the supplementary air flow supplying damper 130*b* to open or shut automatically the automatic opening/shutting devices according to a desired operating condition.

In the air supply damper 130, in other words, the pressure-sensing sensor 140 senses the pressure in the accommodation and the pressure in the lobby 40 and the controller calculates a differential pressure. If the differential pressure between the accommodation 30 and the lobby 40 is less than a certain differential pressure, the automatic opening/shutting device mounted to the leakage air flow supplying damper 130*a* is operated to shut the leakage air flow supplying damper 130*a*, and if the above differential pressure is higher than a certain differential pressure, the automatic opening/shutting device is operated to open the leakage air flow supplying damper 130*a*.

In the air supply damper 130, in addition, the pressure-sensing sensor 140 senses a pressure in the accommodation and a pressure in the lobby 40 and the controller calculates a differential pressure. If the differential pressure between the accommodation 30 and the lobby 40 is less than a certain differential pressure, the automatic opening/shutting device mounted to the supplementary air flow supplying damper 130*b* is operated to open the supplementary air flow supplying damper 130*b*, and if the above differential pressure is higher than a certain differential pressure, the automatic opening/shutting device is operated to shut the supplementary air flow supplying damper 130*b*.

In the automatic opening/shutting devices of the leakage air flow supplying damper 130*a* and the supplementary air flow supplying damper 130*b*, in the case where doors 42 of the lobbies 40 of all floors in the building 101 are closed so that a certain differential pressure is generated between the accommodations 30 and the lobbies 40, the automatic opening/shutting device of the leakage air flow supplying damper 130*a* is opened to supply leakage air flow into each lobby 40 through the leakage air flow supplying blower 111, the leakage air flow supplying passage 121 and the leakage air flow supplying damper 130*a*, and the automatic opening/shutting devices of the supplementary air flow supplying dampers 130*b* of all the floors are shut to block the supply of supplementary air flow.

In other words, if the doors 42 of the lobbies 40 of all the floors are closed, only leakage air flow should be supplied into the lobby 40 of each floor, and supplementary air flow should not be supplied.

To achieve this, leakage air flow is supplied into the lobby 40 of each floor through the leakage air flow supplying blower 111, the leakage air flow supplying passage 121 and the leakage air flow supplying damper 130*a*, and in the case where the doors 42 of the lobbies 40 of all floors are closed so that a certain differential pressure is generated between the accommodations 30 and the lobbies 40, the supplementary air flow supplying dampers 130*b* of all the floors should be shut so as to not supply supplementary air flow into the lobby 40 of each floor.

Accordingly, excessive air supply into the lobby 40 is prevented to enable the door 42 of the lobby 40 to be easily opened in the event of an emergency.

Preferably, the present invention is operated such that, in the case where the door 42 of the lobby 40 is opened so that no differential pressure is generated between the accommodation 30 and the lobby 40, the supplementary air flow supplying damper 130*b* is opened to supply supplementary air flow into the lobby 40 of the floor on which the door 42 is opened, and the leakage air flow supplying damper 130*a* is shut so that leakage air flow is not supplied.

In the case where the door 42 of the lobby 40 is opened during an occupant's emergency evacuation so that no differential pressure is generated between the accommodation 30 and the lobby 40, due to the above, only supplementary air flow is supplied into the lobby 40 of the floor on which the door 42 is opened, and leakage air flow is not supplied.

In a state where differential pressure is not generated between the accommodation 30 and the lobby 40 due to the opened door 42 of the lobby 40, if the leakage air flow supplying damper 130*a* is continuously opened, a large quantity of leakage air flow is supplied to the floor on which the door 42 of the lobby 40 is opened so it is difficult to maintain an appropriate differential pressure between the accommodation 30 and the lobby 40 of another floor.

As described above, the present invention supplies leakage air flow and supplementary air flow into the lobby 40 provided in each floor of the building 101 through a separate flow passage so that it is possible to effectively prevent differential pressure generated between the lobby 40 and the accommodation 30 when a fire occurs in the high-rise building, from becoming lower or higher than the design standard, and to provide safety evacuation conditions.

With reference to FIG. 4, the automatic opening/shutting device and the air supply damper 130 having a function for separately supplying leakage air flow and supplementary air flow, and divided into the leakage air flow supplying damper 130*a* and the supplementary air flow supplying damper 130*b*, are illustrated as bellow.

As described above, the smoke control system 100 to which the air supply damper 130 is applied is provided with the blowing means 110 for supplying the air into the building 101. The above description illustrated that the blowing means 110 includes the leakage air flow supplying blower 111 and the supplementary air flow supplying blower 112.

In addition, the smoke control system is provided with the ventilating means 120 having the leakage air flow supplying passage and the supplementary air flow supplying passage, each of which being connected to the blowing means 110 for introducing the air.

The above ventilating means 120 includes the leakage air flow supplying passage 121 and the supplementary air flow supplying passage 122 extended along the utility-pipe conduit 22 of the building 101 and connected to the leakage air flow supplying blower 111 and the supplementary air flow supplying blower 112, respectively. The above description illustrated that the leakage air flow supplying passage 121 and the supplementary air flow supplying passage 122 are disposed in the utility-pipe conduit 22 and extend in parallel with each other, and form the leakage air flow supplying passage and the supplementary air flow supplying passage.

In addition, the air supply dampers 130 connected to the leakage air flow supplying passage and the supplementary air flow supplying passage of the ventilating means 120 to supply the air according to leakage air flow and supplementary air flow into each lobby 40 of the building 101 are mounted.

The air supply damper 130 having the function for separately supplying leakage air flow and supplementary air flow is illustrated in FIG. 4 and FIGS. 5A, 5B, and 5C.

The air supply damper 130 according to the present invention having the function for separately supplying leakage air flow and supplementary air flow includes a leakage air flow control blade 131 and a supplemental air flow control blade 132 which are connected to the leakage air flow supplying passage 121 and the supplementary air flow supplying passage 122, respectively, through a leakage air flow connecting duct 161 and a supplementary air flow connecting duct 162 to supply the air into each lobby 40 of the building 101.

In the air supply damper 130 according to the present invention having the function for separately supplying leakage air flow and supplementary air flow, in other words, the leakage air flow control blade 131connected to the leakage air flow supplying passage 121 of the leakage air flow supplying blower 111 via the leakage air flow connecting duct 161 forms the leakage air flow supplying passage, and the supplemental air flow control blade 132connected to the supplemental air flow supplying passage 122 of the supplemental air flow supplying blower 112 via the supplemental air flow connecting duct 162 forms the supplemental air flow supplying passage to allow the supply of leakage air flow and the supply of supplementary air flow into the building 101 to be provided through separate flow passages.

The air supply damper 130 according to the present invention having the function for separately supplying leakage air flow and supplementary air flow is provided with the pressure-sensing sensor 140 measuring differential pressure (ΔP) between a pressure (PL) in the lobby and a pressure (PA) in the accommodation, and the controller 134 receiving the measured input value from the pressure-sensing sensor 140 to separately operate driving motors 133 which open/close the leakage air flow control blade 131 and the supplementary air flow control blade 132, respectively.

Accordingly, the air supply damper 130 according to the present invention having the function for separately supplying leakage air flow and supplementary air flow is constructed such that the controller 134 separately adjusts the opening rate of the leakage air flow control blade 131 or the supplementary air flow control blade 132 through the driving motors 133 by means of the differential pressure ΔP between the lobby pressure PL and the accommodation pressure PA obtained by the pressure-sensing sensor 140 to adjust the supplying amount of leakage air flow or supplementary air flow.

As shown in FIGS. 5A, 5B, 5C and FIG. 6, accordingly, in the air supply damper 130 according to the present invention having the function for separately supplying leakage air flow and supplementary air flow, the leakage air flow control blade 131 and the supplementary air flow control blade 132 are connected to the driving motors 133 via links, respectively, and a rotational operation of the driving motor 133 is transformed into a linear motion via the link 135 to open/shut the leakage air flow control blade or the supplementary air flow control blade.

In addition, since the leakage air flow control blade 131 and the supplementary air flow control blade 132 as described above are connected to the leakage air flow supplying passage 121 of the leakage air flow supplying blower 111 and the supplementary air flow supplying passage 122 of the supplementary air flow supplying blower 112 via the leakage air flow connecting duct 161 and the supplementary air flow connecting duct 162, respectively, it is possible to separately supply leakage air flow or supplementary air flow into the lobby 40 through an opening/shutting operation of each control blade.

Hereinafter, a method 300 for controlling the air supply damper according to the present invention having the function for separately supplying leakage air flow and supplementary air flow is illustrated in more detail.

In the method 300 for controlling the air supply damper according to the present invention having the function for separately supplying leakage air flow and supplementary air flow, as shown in FIG. 7, the air supply damper 130 through which the leakage air flow control blade 131 and the supplementary air flow control blade 132 are communicated with each other is provided in the leakage air flow supplying passage 121 and the supplementary air flow supplying passage 122 in the utility-pipe conduit 22, which separately supply leakage air flow and supplementary air flow into the lobby 40, to enable the supply of leakage air flow and supplementary air flow to be separately controlled, the leakage air flow control blade 131 and the supplementary air flow control blade 132 being arranged in parallel through the leakage air flow connecting duct 161 and the supplementary air flow connecting duct 162.

The pressure-sensing sensor 140 measures differential pressure (ΔP) between the lobby pressure PL and the accommodation pressure PA and the measurement is transmitted to the controller 134. Using the measured pressure value transmitted from the pressure-sensing sensor 140, the controller 134 operates the driving motors 133 which separately adjust the opening rate of the leakage air flow control blade 131 or the supplementary air flow control blade 132.

By controlling each of the driving motors 133 through the controller 134, the supplying amount of the leakage air flow and the supplying amount of the supplementary air flow control blade 132 are separately adjusted.

As shown in FIG. 7, during an operation of the above controller 134, in the method 300 for controlling the air supply damper according to the present invention having the function for separately supplying leakage air flow and supplementary air flow, the pressure-sensing sensor 140 senses successively the differential pressure ΔP between the lobby pressure PL and the accommodation PA in a state where the door 42 of the lobby 40 is closed, if the current sensed differential pressure ΔP is larger than a primary differential pressure ΔP1 set in a control logic, the air supply damper is operated such that the leakage air flow control blade 131 is opened and the supplementary air flow control blade 132 is shut to supply only leakage air flow into the lobby 40.

Simultaneously, in order to maintain the differential pressure ΔP between the lobby pressure PL and the accommodation pressure PA at a design standard differential pressure ΔP2, the opening degree of the leakage air flow control blade 131 is adjusted.

In a state where the door 42 of the lobby 40 is closed, in other words, once external air is supplied into the lobby 40, the differential pressure ΔP between the lobby pressure PL and the accommodation pressure PA is larger than the primary differential pressure ΔP1, that is, the primary differential pressure ΔP1 of approximately 10 Pa set in the control logic, so that when the differential pressure ΔP between the lobby pressure PL and the accommodation pressure PA is larger than the primary differential pressure ΔP1, that is, approximately 10 Pa as described above, the leakage air flow control blade 131 is opened and the supplementary air flow control blade 132 is shut to supply only leakage air flow into the lobby 40. Simultaneously, in order to maintain the differential pressure ΔP between the lobby pressure PL and the accommodation pressure PA at a design standard differential pressure ΔP2, the opening degree of the leakage air flow control blade 131 is adjusted so that the function of supplying separately leakage air flow and supplementary air flow is performed as shown in Table 1 (Method for controlling the air supply damper 130 in a state where the door 42 of the lobby 40 is closed).

TABLE 1

| Condition | Method for controlling the air supply damper 130 | |
|---|---|---|
| Door 42 of lobby 40 is closed | Leakage air flow control blade 131 | Supplementary air flow control blade 132 |
| ΔP is larger than ΔP1 | Opened at the time at which ΔP is higher than ΔP1. Adjust a supplied leakage air flow by controlling an open degree of the leakage air flow control blade 131 to maintain ΔP as ΔP2 | Closed at the time on which ΔP is higher than ΔP1. |

In addition, in the method 300 for controlling the air supply damper according to the present invention having the function for separately supplying leakage air flow and supplementary air flow, the pressure-sensing sensor 140 senses successively the differential pressure ΔP between the lobby pressure PL and the accommodation PA in a state where the door 42 of the lobby 40 is opened, if the current sensed differential pressure ΔP is smaller than the primary differential pressure ΔP1 set in the control logic, that is, in general, 10 Pa, the air supply damper is operated such that the leakage air flow control blade 131 is shut and the supplementary air flow control blade 132 is opened to supply only supplementary air flow into the lobby 40.

In a state where the door 42 of the lobby 40 is opened, in other words, since the differential pressure ΔP between the lobby pressure PL and the accommodation pressure PA is smaller than the primary differential pressure ΔP1 of approximately 10 Pa, when the differential pressure ΔP between the lobby pressure PL and the accommodation pressure PA is smaller than the primary differential pressure ΔP1, the air supply air damper is operated such that the leakage air flow control blade 131 is shut and the supplementary air flow control blade 132 is opened to supply only supplementary air flow into the lobby 40, and so the air supply damper has the function of separately supplying leakage air flow and supplementary air flow as shown in Table 2 (Method for controlling the air supply damper 130 in a state where the door 42 of the lobby 40 is opened).

TABLE 2

| Condition | Method for controlling the air supply damper 130 | |
|---|---|---|
| Door 42 of lobby 40 is opened | Leakage air flow control blade 131 | Supplementary air flow control blade 132 |
| ΔP is smaller than ΔP1 | Closed at the time on which ΔP is lower than ΔP1 | Completely open at the time on which ΔP is lower than ΔP1 |

As illustrated above, the air supply damper having the function for separately supplying leakage air flow and supplementary air flow and the method for controlling the same according to the present invention can prevent in advance, differential pressure ΔP between a pressure of the accommodation and a pressure of the lobby 40, which is the smoke control zone, from becoming larger or smaller than the standard value, and provide safety evacuation conditions when a fire occurs in the high-rise building.

Even though the specific embodiment of the present invention is illustrated in detail with reference to the drawings, the present invention is not limited to the specific structure as above. One skilled in the art can change or modify variously the present invention without departing the spirit and scope of the present invention defined in claims.

In the air supply damper 130, for example, it is obvious that the links 135 connecting the driving motors 133 to the leakage air flow control blade 131 and the supplementary air flow control blade 132 may have various configurations.

In addition, the above links 135 having the same configuration can be applied to the leakage air flow control blade 131 and the supplementary air flow control blade 132, respectively, however, the links may have the different configurations. However, it is apparent that the above modified or changed configuration of the link is within the scope of the present invention.

The invention claimed is:

1. An air supply damper of a smoke control system provided in a high-rise building, the supply damper having a function for separately supplying leakage air flow and supplementary air flow, comprising:

a leakage air flow control blade and a supplemental air flow control blade provided in a leakage air flow supplying passage and a supplementary air flow supplying passage of a utility-pipe conduit for separately supplying the leakage air flow and the supplementary air flow by different air blowers, respectively, through a leakage air flow connecting duct and a supplementary air flow connecting duct, the leakage air flow control blade and the supplemental air flow control blade being arranged in parallel with each other and capable of adjusting the supply of the leakage air flow and the supplementary air flow, respectively;

a pressure-sensing sensor measuring differential pressure between a lobby pressure and an accommodation pressure; and a controller receiving a measured pressure value from the pressure-sensing sensor, and separately driving driving motors which open/shut the leakage air flow control blade and the supplemental air flow control blade, respectively, wherein an opening rate of the leakage air flow control blade or the supplementary air flow control blade is separately adjusted through the driving motors by means of the differential pressure between the lobby pressure and the accommodation pressure obtained by the pressure-sensing sensor to adjust the supplying amount of the leakage air flow or the supplementary air flow, wherein the controller judges whether a door of a lobby is opened according to the differential pressure between the lobby pressure and the accommodation pressure, when it is determined that the door of the lobby is opened, the controller opens the supplementary air flow control blade and shuts the leakage air flow control blade to supply only the supplementary air flow into the lobby.

2. The air supply damper having the function for separately supplying the leakage air flow and the supplementary air flow of claim 1, wherein, on the basis of a signal transmitted from the pressure-sensing sensor, the controller judges that the door of the lobby is closed if the current sensed differential pressure is larger than a primary differential pressure set in a control logic, opens the leakage air flow control blade and shut the supplementary air flow control blade to supply only the leakage air flow into the lobby, and control the driving motor to adjusts the opening rate of the leakage air flow control blade for maintaining differential pressure between the lobby pressure and the accommodation at a design standard differential pressure.

3. The air supply damper having the function for separately supplying the leakage air flow and the supplementary air flow of claim 1, wherein the pressure-sensing sensor senses successively the differential pressure between the lobby pressure and the accommodation pressure, judges that the door of the lobby is opened if the current sensed differential pressure is smaller than a primary differential pressure set in a control logic, opens the supplementary air flow control blade, and shuts the leakage air flow control blade to supply only the supplementary air flow into the lobby.

4. A method of an air supply damper of a smoke control system provided in a high-rise building, the air supply damper having the function for separately supplying leakage air flow and supplementary air flow, comprising the steps of:

judging, by a controller of the smoke control system, whether a door of a lobby is closed;

sensing successively, by the controller of the smoke control system, a differential pressure between a lobby pressure and an accommodation pressure;

determining, by the controller of the smoke control system, whether the sensed differential pressure is larger than a primary differential pressure set in a control logic; and separately adjusting, by the controller of the smoke control system, an opening rate of a leakage air flow control blade or a supplementary air flow control blade on the basis of the sensed differential pressure to separately adjust the supplying amount of the leakage air flow or the supplementary air flow, wherein the leakage air flow and the supplementary air flow are supplied by different air blowers, wherein when it is judged, by the controller, that the door of the lobby is opened according to the differential pressure between the lobby pressure and the accommodation pressure, opening the supplementary air flow control blade and shutting the leakage air flow control blade to supply only the supplementary air flow into the lobby by the controller.

5. The method for controlling the air supply damper having the function for separately supplying the leakage air flow and the supplementary air flow of claim 4, wherein if the sensed differential pressure is larger than the primary differential pressure set in the control logic in the case where the door of the lobby is closed, the leakage air flow control blade is opened at the time at which the sensed differential pressure becomes larger than the primary differential pressure, to adjust an opening rate of the leakage air flow control blade for maintaining the sensed differential pressure at a design standard differential pressure, and the supplementary air flow control blade is shut at the time at which the sensed differential pressure becomes larger than the primary differential pressure, to supply only the leakage air flow into the lobby.

6. The method for controlling the air supply damper having the function for separately supplying the leakage air flow and the supplementary air flow of claim 4, wherein if the sensed differential pressure is smaller than the primary differential pressure set in the control logic in the case where the door of the lobby is opened, the leakage air flow control blade is shut at the time at which the sensed differential pressure becomes smaller than the primary differential pressure, the supplementary air flow control blade is completely opened at the time at which the sensed differential pressure becomes smaller than the primary differential pressure, to supply only the supplementary air flow into the lobby.

7. A smoke control system provided in a high-rise building comprising a plurality of floors for separately supplying leakage air flow and supplementary air flow, comprising:

a blowing means for supplying air into the building, wherein the blowing means is provided with a leakage air flow supplying blower and a supplementary air flow supplying blower for supplying the air into the building;

a ventilating means having a leakage air flow supplying passage and a supplementary air flow supplying passage respectively connected to the leakage air flow supplying blower and the supplementary air flow supplying blower for respectively introducing air into the leakage air flow supplying passage and the supplementary air flow supplying passage;

an air supply damper connected to the leakage air flow supplying passage and the supplementary air flow supplying passage to supply the air into a lobby of each floor of the building according to the leakage air flow and the supplementary air flow, wherein the air supply damper is provided with a leakage air flow supplying damper and a supplementary air flow supplying damper connected to the leakage air flow supplying passage and the supplementary air flow supplying passage, respectively, to supply the air into the lobby of the building, for allowing the leakage air flow and the supplementary air flow to be separately supplied into the lobby of each floor of the building; and a pressure-sensing sensor for sensing the pressure in the lobby and the pressure in an accommodation of the building, the leakage air flow supplying damper having an automatic opening/shutting device mounted therein for closing the leakage air flow supplying damper when the differential pressure between the pressures of the lobby and the accommodation sensed by the pressure-sensing sensor is smaller than a certain differential pressure, and opening the leakage air flow supplying damper when the differential pressure between the pressures of the lobby and the accommodation is larger than the certain differential pressure, and the supplementary air flow supplying damper having an automatic opening/shutting device mounted therein for closing the supplementary air flow supplying damper when the differential pressure between the pressures of the lobby and the accommodation sensed by the pressure-sensing sensor is larger than the certain differential pressure, and opening the supplementary air flow supplying damper when the differential pressure between the pressures of the lobby and the accommodation is smaller than the certain differential pressure, wherein it is determined, by a controller, that a door between the lobby and the accommodation is opened when the differential pressure between the pressures of the lobby and the accommodation on each floor is smaller than the certain differential pressure, and the door between the lobby and the accommodation is closed when the differential pressure between the pressures of the lobby and the accommodation on each floor is larger than the certain differential pressure.

8. The smoke control system in the high-rise building for separately supplying the leakage air flow and the supplementary air flow of claim 7, wherein in the case where the doors of the lobbies of all the floors of the building are closed so that a certain differential pressure is formed between the lobbies and the accommodations, the automatic opening/shutting devices of the leakage air flow supplying dampers of all the floors are opened to supply the leakage air flow therethrough, and the automatic opening/shutting devices of the supplementary air flow supplying dampers of all the floors are shut to block the supply of supplementary air flow.

9. The smoke control system in the high-rise building for separately supplying the leakage air flow and the supplementary air flow of claim 7, wherein in the case where the doors of the lobbies of all the floors of the building are opened so that a differential pressure is not formed between the lobbies and the accommodations, the automatic opening/shutting devices of the supplementary air flow supplying dampers of all the floors are opened to supply only supplementary air flow into the lobbies, and the automatic opening/shutting devices of the leakage air flow supplying dampers of all the floors are shut so that the leakage air flow is not supplied.

* * * * *